United States Patent [19]

Britton et al.

[11] 4,160,612

[45] Jul. 10, 1979

[54] TUBE CLOSURE

[75] Inventors: Fred G. Britton, Bedford; Robert J. Von Bose; Cecil T. Keller, both of Arlington, all of Tex.

[73] Assignee: Oil States Rubber Co., Arlington, Tex.

[21] Appl. No.: 901,488

[22] Filed: May 1, 1978

[51] Int. Cl.[2] ..... E02B 17/04

[52] U.S. Cl. ..... 405/227; 405/199; 138/89

[58] Field of Search ..... 61/86, 94, 98, 89, 63, 61/112; 138/89, 93; 137/488; 294/86.24; 405/227, 199, 195, 197

[56] References Cited

U.S. PATENT DOCUMENTS

| | | | |
|---|---|---|---|
| 3,577,737 | 5/1971 | Burleson | 61/86 |
| 3,593,749 | 7/1971 | Reardon | 138/93 |
| 3,978,678 | 9/1976 | Duncan et al. | 61/112 |
| 4,050,731 | 9/1977 | Coone et al. | 61/94 X |

*Primary Examiner*—Jacob Shapiro

*Attorney, Agent, or Firm*—Gerald G. Crutsinger; Larry B. Dwight

[57] ABSTRACT

A tube closure for use in a pile or leg connectable to the inside of a pile or leg between the ends of a pile or leg to divide the pile or leg into separate compartments to permit control flooding of each compartment. A locking ring is installed in the inside of the pile or leg to allow engagement of locking dogs with the pile or leg to limit longitudinal movement of the closure system through the pile or leg. The locking dogs are operably connected to a hub which when lifted moves the locking dogs away from the locking ring to disengage the system. An inflatable rubber packer is formed around the closure to seal off the area between the closure and the inner wall of the pile or leg. Once the piling or leg is in location, the rubber packer is deflated and the system is removed by a wire line which lifts a hub secured to the dogs to move the dogs out of engagement with the locking ring before lifting the assembly from its position. A valve is provided to allow equalization of the hydrostatic pressure across the plug by flooding prior to removal of the closure.

8 Claims, 4 Drawing Figures

TUBE CLOSURE

BACKGROUND OF THE INVENTION

The apparatus described herein is a closure system particularly adapted to use in conjunction with pilings which are driven through piling guides to secure an offshore drilling platform to the ocean floor.

Offshore drilling platforms are generally supported by towers constructed of prefabricated sections secured thereto. The offshore drilling platform support structure generally comprises a base which is anchored by pilings to the ocean floor. A typical support structure has a plurality of main legs sections and if employed as a base section which is to be anchored to the ocean floor, the section will be supplied with piling guides comprising pipe having an outside diameter of, for example, six to seven feet or less. The pilings have an equal diameter and are slideably disposed through the piling guides. Pilings are driven through a rupturable seal assembly secured on the lower end of the piling guides such as that disclosed in U.S. Pat. No. 3,533,241 to Bowerman, et al, entitled "Rupturable Seal Assembly for Piling Guides".

The pilings are generally separate from the base of the offshore drilling platform and are generally floated to the site for positioning in the piling guides after the base has been flooded and positioned on the ocean floor. The pilings usually have an upper and lower closure for sealing off the pile and preventing hydrostatic pressure from entering the pile. The pilings must be flooded and guided downwardly prior to engaging the piling guide and being driven in position and exposed to hydrostatic pressures in an excess of 650 psi. It is desirable to provide controlled flooding of the pile or other tubular member to allow more accurate positioning of the piling within the piling guide, and to prevent rupture of the piling which is usually several hundred feet long and very flexible.

The tube closure may also be employed in piling guides and main legs of the support structure to allow the structure to be set gently on the ocean floor.

Heretofore, pipe closure plugs have been employed to control the flooding. Typical pipe closure systems are disclosed in the following U.S. Pat. Nos.: 3,537,483; 3,593,749; 3,724,273; 3,746,026; 3,884,261; and 3,943,982. These devices generally relate to retractable plugs used in pipe lines having a much smaller diameter than pilings. Generally, as disclosed in U.S. Pat. No. 3,537,483 the devices require a flange which is not possible to provide with the seamless exterior wall of the piling which must be driven through a piling guide. Some devices disclosed in the patents listed above rely on frictional forces with the interior wall of the pipe which would not be sufficient to withstand the extreme hydrostatic pressures encountered in installation of offshore drilling platforms.

The devices generally disclose long linkage arms to retract the locking mechanism which is not practical when used in the pilings.

SUMMARY OF THE INVENTION

The tube closure or pile closure system disclosed herein is devised for use in large cylindrical sections such as pilings wherein it is desired to divide the piling into single or separate compartments and where complete closure between these compartments is required at high hydrostatic pressures. The system comprises a diaphragm element closing most of the cross-section of the cylindrical section to provide a water-tight seal in combination with an inflatable rubber packer which seals with the wall of the piling. A mechanical support system has been devised to withstand the hydrostatic force applied against the diaphragm and seal when the lower compartment of the piling has been flooded. The closure system is removable from the pile when the piling has been positioned.

A support casing securing the diaphragm in place provides support for a plurality of spaced retractable locking dogs pivotally secured to the upper portion of the casing and moveable into an extended position engaging a locking ring secured to the inner wall of the piling. A retraction system generally comprises a hub having an adjustable retracting link pivotally secured to the hub and the lower end of the locking dog such that as the hub is moved axially the locking dog is pivoted to withdraw the locking dog from the locking ring to a retracted position.

The hub is secured to a mandrel which is suitable supported by an upper and lower support journals. A lifting device is secured to the mandrel and connected to the surface of the ocean by a cable. The mandrel is secured in position by a shear pin to resist movement of the hub and inwardly movement of the locking dog due to the hydrostatic pressures.

The assembly is positioned within the piling which is then moved to the location of the drilling platform. The lower compartment is generally flooded to submerge the piling toward the location of the piling guide. Guide cables and divers guide the still relative bouyant piling into the piling guide. Once the flexible piling, which may be over 600 feet long, is sufficiently positioned in the piling guide and bottoms on the ocean floor, a flood valve is operated to allow flooding of the upper compartment through the closure.

Upon equalization of the hydrostatic pressures on each side of the closure, the inflatable rubber packer is deflated as axial force is applied to the cable. The force on the cable pulls a detachable connector off of the inflation line of the packer. Once deflated, axial force is applied to the mandrel which shears the shear pin allowing lifting of the hub. As the hub lifts, the retraction rods are pulled inwardly pulling the locking dogs away from the locking rings. Further, axial force lifts the hub to its full upward position to assure clearance of the locking dogs from the locking ring. In the upward position the hub engages a stop member which allows movement of the assembly out of the piling. Wheel assemblies are provided which engage the inner wall of the piling to allow guiding of the assembly outwardly without undue friction and possible damage to the inner wall of the piling.

A primary object of the invention is to provide a tube closure system and support structure which may be used in a large piling to seal or divide the piling into separate compartments to allow controlled flooding of the piling and thus the control of the positioning of the piling as the piling is submerged.

Another object of the invention is to provide a pile closure which is capable of withstanding large hydrostatic forces and which is disengagable from the pile from a remote location by applying an axial force to the device.

Another object of the invention is to provide a closure system having a plurality of locking dogs which are maintained in a locked position by relatively small amount of force compared to the large hydrostatic forces being applied in a perpendicular direction, thus, facilitating disengagement of the locking dogs upon removal of the system.

A further object of the invention is to provide a pile closure system having locking dogs which are independently adjustable of the other locking dogs to assure proper engagement of the locking ring even though the piling may not be perfectly round.

Other and further objects of the invention will become apparent upon referring to the detailed description hereinafter following and the drawings annexed hereto.

DESCRIPTION OF THE DRAWINGS

Drawings of a preferred embodiment of the pile closure system are annexed hereto so that the invention may be better and more fully understood, in which.

Numeral references are employed to designate like parts throughout the various figures of the drawing.

DESCRIPTION OF A PREFERRED EMBODIMENT

Figure 1:
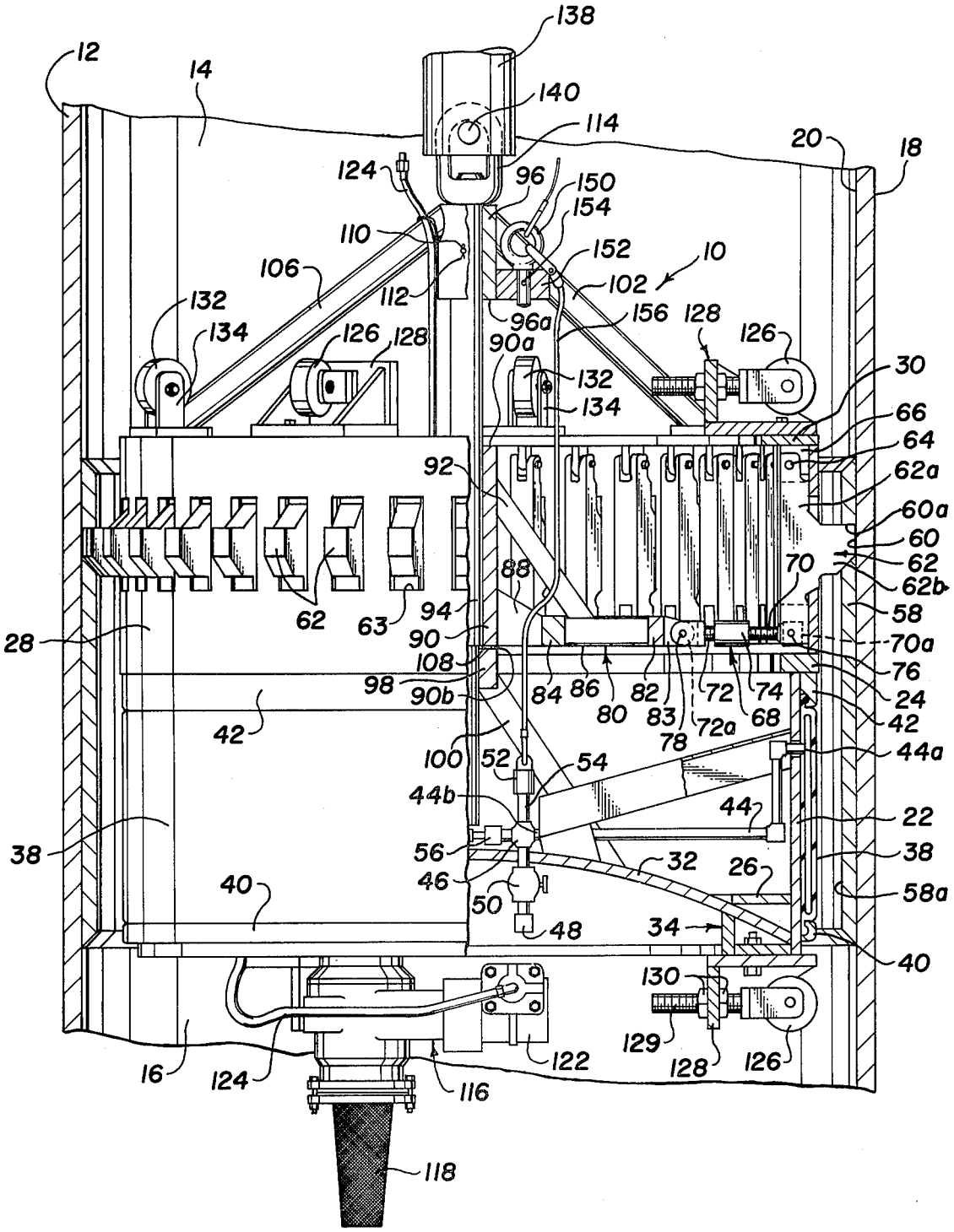
FIG. 1 is an elevational view of the closure system secured in the piling with parts broken away to more clearly illustrate the details of construction.
Figure 2:
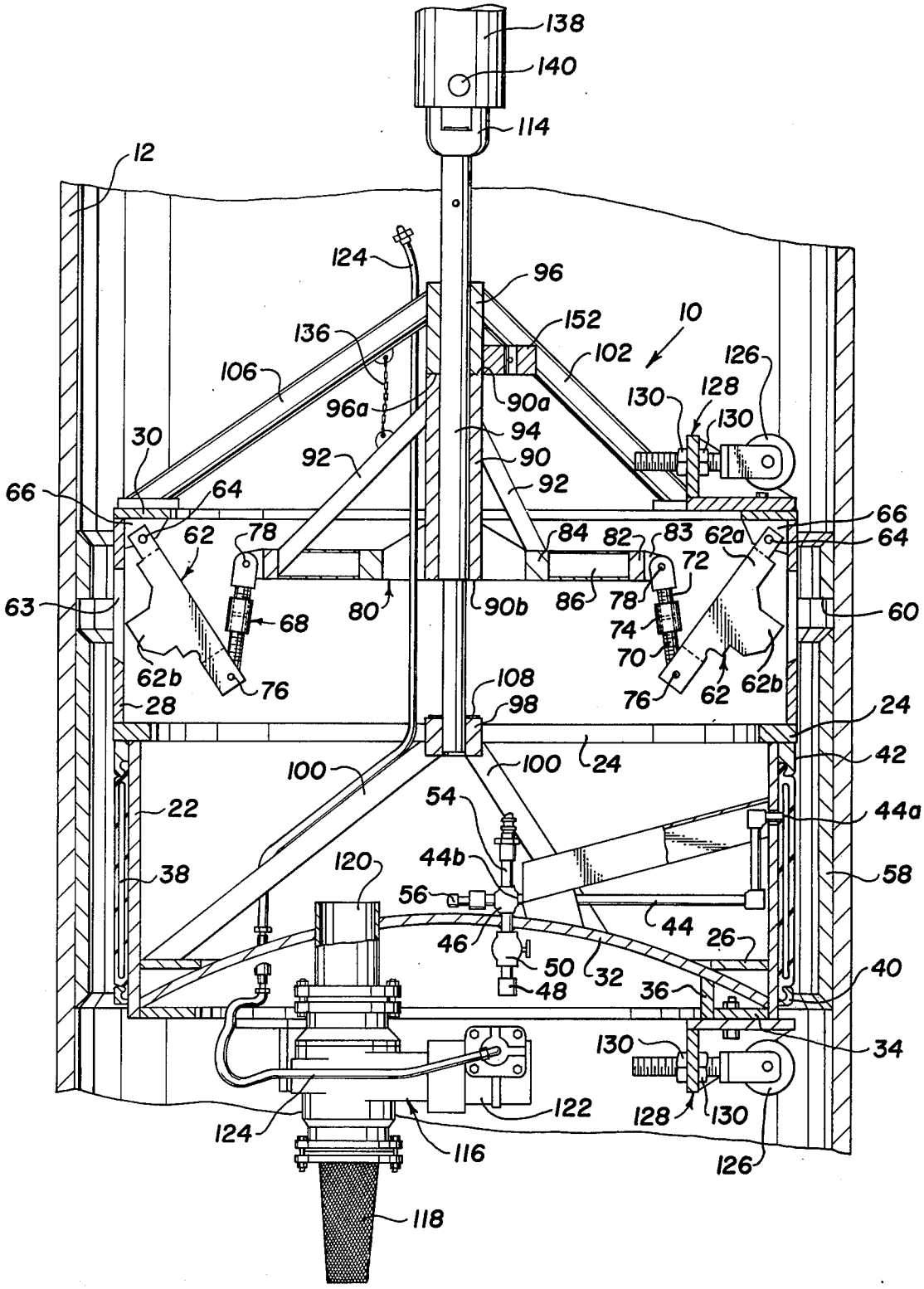
FIG. 2 is a cross-sectional view similar to FIG. 1 with the connector means shown in the retracted position with parts broken away to more clearly illustrate the details of construction.
Figure 4:
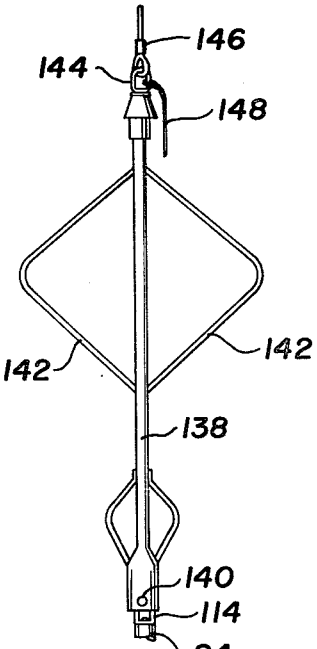
FIG. 4 is a reduced elevational view of the removal guide.
Figure 3:
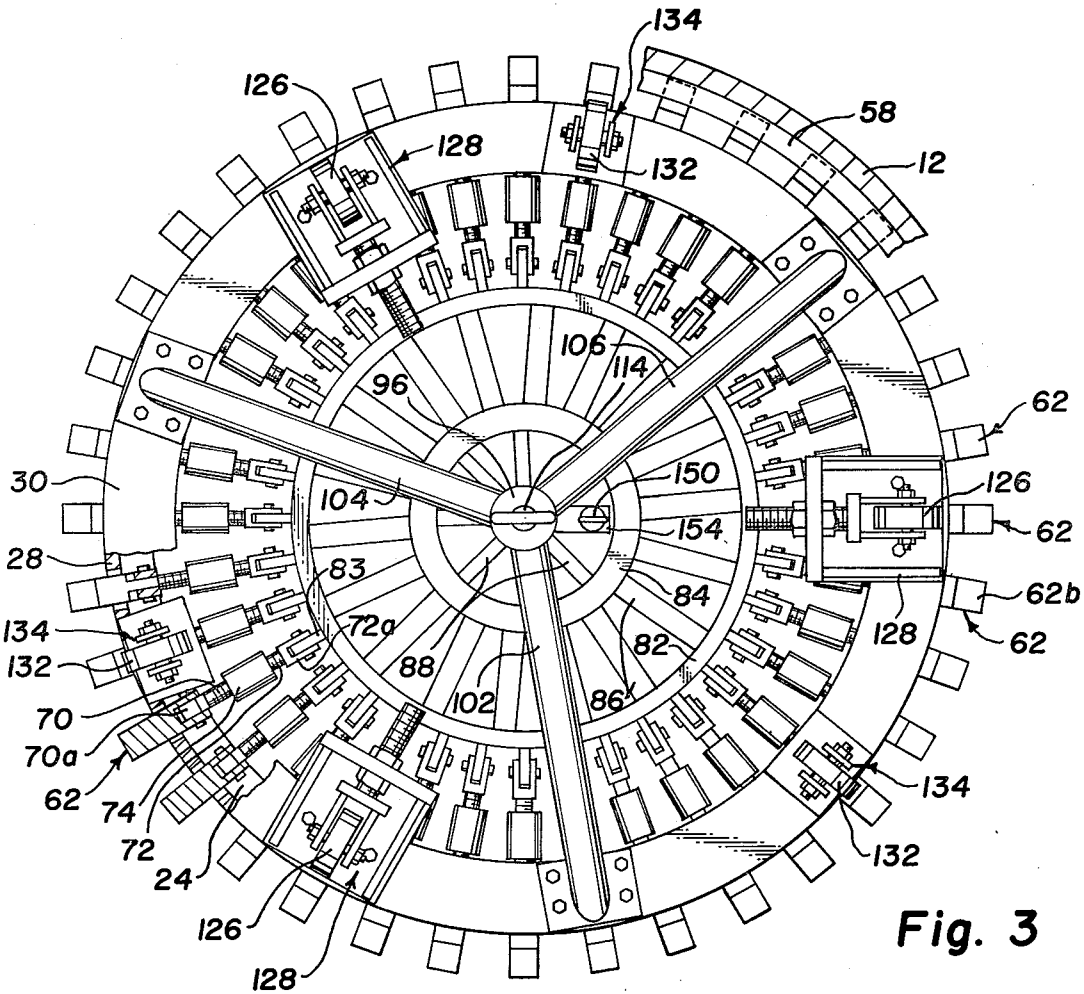
FIG. 3 is a top plan view thereof with parts broken away to more clearly illustrate the details of construction.

Referring to FIGS. 1–3 of the drawing, the numeral 10 generally designates the middle pile closure which is secured within a piling 12 to divide the piling 12 into an upper compartment generally designated 14 and a lower compartment generally designated 16. The piling 12 is generally a long tubular section of pipe, for example, 600 feet long and having a diameter of six to eight feet. The piling 12 has a smooth seamless exterior wall 18 and inner wall 20 and is slideably disposed in a piling guide (not shown) such as the type disclosed in U.S. Pat. No. 3,533,241 for securing the base section of a drilling platform to the ocean floor. The pile closure 10 may be positioned approximately 100 feet from the end of the piling 12. The piling 12 is sealed at both ends to provide a means to float the piling 12 to the location of the drilling platform.

The pile closure 10 has a support structure generally comprising a cylindrical casing 22 having a middle flange 24 and lower flange 26. An upper cylindrical casing 28 is secured to flange 24 and has a upper flange 30 formed thereon.

A seal assembly such as rigid concave bulkhead 32 is secured within the inner wall of lower casing 22 on the lower side of flange 24 to limit inward movement.

An inflatable rubber packer 38 provides an annular seal means about casing 22 and bulkhead 32 to engage the inner surface of piling 12. The inflatable packer 38 is secured to the exterior of lower casing 22 by annular lugs 40 and 42. The inflation assembly generally comprises a conduit 44 having an end **44*a* which communicates with the inside of the packer 38 and a second end 44*b* communicates with a four-way connector 46 and inflation nozzle 48 is secured to valve 50 which communicates with the connector 46. A quick disconnect plug 52 is detachable secured to outlet line 54 which communicates with conduit 44 through connector 46 for deflation of the packer 38** which will be more fully explained later.

A transducer 56 for monitoring the pressure in conduit 44 and packer 38 communicates with the connection unit 46 and transmits pressure signals to a remote location above the piling 12 by means such as an electrical connection or radio transmitter (not shown).

A cylindrical locking ring 58 having an annular dog receiving groove 60 is welded or otherwise secured to the inner wall 20 of piling 12 at the desired location of the pile closure device 10. Groove 60 forms a shoulder **60*a***.

Connector means such as plurality of spaced retractable dogs 62 pivotally secured by pins 64 to a plurality of lugs 66 welded or otherwise secured to upper flange 30 are operably positioned in an extended position through passages 63, as illustrated in FIG. 1. The retractable dogs 62 have a tongue **62*b* to engage shoulder 60*a* of dog receiving groove 60 in locking ring 58. Pins 64 are secured through aligned passages in the upper end of dog 62 and lugs 66 by cotter pins. Dogs 62 generally comprise a shank 62*a* and outwardly extending tongue 62*b*. The lower end of the shank 62*a* of dogs 62 are secured to a plurality of radially extending retractor rods 68 each comprising a first threaded rod 70 and second threaded rod 72 secured by an internally threaded adjustable nut 74. The yoke of threaded rod 70 is secured by dog pin 76 through aligned passages in the lower end of dog 62 and yoke 70*a*. Threaded shaft 72 is secured to yoke 72*a* which is secured by a hub pin 78 to the central hub lifting means 80 by lugs 83. The central hub lifting means 82 has an outer hub ring 82 spaced from inner hub ring 84 connected by a plurality of spokes 86. Inner hub ring 84 is secured by a plurality of connector members 88 to sleeve 90 and is braced by angle members 92 secured between the upper end 90*a* of sleeve 90 and spokes 86. Sleeve 90 is rigidly secured to the central mandrel 94**.

The central mandrel 94 is slideably disposed through upper and lower support journals 96 and 98, respectively. Lower support journal 98 is secured to the upper apex of a plurality of spaced angle members 100 which are secured to flange 26 on lower casing 22. The upper support journal 96 is supported by one or more angularly disposed support members 102, 104 and 106 extending radially inwardly and upwardly from flange 30 on casing 28, the lower end of which is bolted or otherwise secured to the flange 30.

Spacer means such as washer 108 is provided to adjust the lower position of hub 80 by spacing lower end **90*b* of sleeve 90 from lower support journal 98. The position of the lower end is preferably adjusted by the thickness of washer 108 such that hub pin 78 will be approximately ¾ of an inch lower than dog pin 76 when dogs 62 are in the fully extended position illustrated in FIG. 1. Thus, forces from the hydrostatic pressure from compartment 16 causing any inward movement of dogs 62 62 will be resisted by the off center position of retracting rod 68 such that the forces will not be transmitted upwardly through mandrel 94**.

After positioning of the pile closure 10 in piling 12, shear pin 110 limits upward movement of mandrel 94 within upper and lower journals 96 and 98. Shear pin 110 is positioned through aligned passages in upper support journal 96 and mandrel 94 and secured thereto by a cotter pin 112. Lifting means such as lifting eye 114 are provided for lifting the devices as will be further explained hereinafter. Means to limit upper travel comprises the lower surface 96a of upper support journal 96 which engages the upper surface 90a of sleeve 90.

Means to equalize pressure on each side of the bulkhead 32 generally comprises a flood valve 116 having an inlet strainer 118 and an outlet 120 on the opposite side of diaphragm 32. The flood valve 116 is controlled by a hydraulically actuated mechamism 122 which is secured to a hydraulic actuator line 124 which is connected to the surface for control of the flood valve 116.

To facilitate positioning of the pile closure within the piling 12, guide wheels 126 are positioned in wheel assemblies 128 at spaced locations on the upper and lower surfaces of the closure 10 and secured to upper flange 30 and lower flange assemblies 34. Wheels 26 are adjustably radially out by threaded shank 129 secured through a passage in the assembly 128 and secured between nuts 130. The wheels 126 are adapted to engage the inner wall 20 of piling 12 so that it may be slideably disposed through the piling. Additionally, wheels 132 on wheel support assembly 134 are secured in spaced relation on the upper flange 30 of the pile closure 10. It should be appreciated that wheels 126 are adjustable radially to engage the inner wall 20 to facilitate positioning of the pile closure 10 within piling 12.

As illustrated in FIG. 2, a transport chain 136 is provided for maintaining the hub 80 in a lifted position when transporting the pile closure 10 into position. The chain 136 is removed after positioning within the piling 12.

Lifting means comprises eye 114 secured to a lifting sleeve 138 by pin 140. Lifting sleeve 138 has centering guides 142 adapted to engage the inner wall 20 of piling 12. The upper end of lifting sleeve 138 is secured to a lifting eye 144 which is secured to a lifting wire 146. Due to the weight of the pile closure 10 a cable is generally capable of withstanding the forces necessary to lift 15,000–50,000 pounds.

Cable 146 is also secured to a second line 148 which is secured to anchor 150 secured to lug 152 by shear pin 154. Anchor 150 is secured to a packer release mechanism such as line 156 which is connected at the opposite end to quick disconnect 52 on outlet 54 of conduit 44 connected to bladder 38. It should be readily apparent that an axial motion of cable 146 pulls cable 148 to pull anchor 150 shearing the pin 154 thus aligning lifting of line 56 to pull quick disconnect 52 off outlet 54 deflating inflatable packer 58.

Operation of the hereinbefore described device is as follows:

The pile closure 10 is rolled through the piling 12 at the assembly point preferably adjacent a shore line until it it is positioned adjacent locking ring 58. The wheels 126 engage the inner wall 20 to aid in positioning the closure 10. Once in position, chain 136 is removed to allow movement of mandrel 94 and hub 80 to a lower position against washer 180 above lower support journal 98.

Thus, locking dogs 62 are moved from the retracted position shown in FIG. 2 to an extended position shown in FIG. 1 wherein they engage shoulder 60a of annular dog receiving groove 60 in locking ring 58. The tongue 62b on dog 62 moves through openings 63 formed in the upper casing 28. Once the hub 80 is in a lowered position shear pin 110 is positioned through the aligned apertures in upper support journal 96 to limit longitudinal movement of the mandrel 94 therethrough. The cotter pin 112 is positioned in place on shear pin 110.

A source of pressure is connected to inflation nozzle 48 to inflate the rubber packer 38 to urge same in sealing contact against the inner wall 58a of ring 58. Once the closure 10 is in position, the lifting line 146 hydraulic connection 124 and transducer line are journalled out the top closure of the piling 12 (not shown) for connection to the appropriate equipment at the work site.

Piling 12 is then towed to the platform site and positioned on the surface of the ocean in approximate position above the piling guide through which it will be disposed. Flooding in the lower compartment 16 is started through a lower enclosure such that the lower end of the piling 12 will become submerged moving the piling 12 lower into the ocean. Hydrostatic pressure through the pile closure 10 is prevented by bulkhead 32 and packer 38. Once the piling 12 is positioned in the piling guide and substantially therethrough, hydraulic line 124 is pressurized to actuate the hydraulic actuator mechanism 122 on valve 116 to permit equalization of the hydrostatic pressure on each side of bulkhead 32. A source of fluid pressure is secured to hydraulic line 124 at the surface such as pumps typically used and known. Thus, the upper compartment 14 is flooded with sea water to equalize the pressure in compartments 14 and 16. When pressure is finally equalized, axial movement of line 146 tightens line 148 to pull anchor 150 out of lug 152 shearing pin 154. This permits axial movement of line 156 upwardly to pull the quick disconnect 52 off of outlet line 54 permitting escape of pressure from the inflatable rubber packer 38 and deflation of the bladder. Once the packer 38 has been completely deflated, further axial movement of line 46 delivers axial force on mandrel 94 to shear pin 150.

When pin 150 is sheared mandrel 94 continues to move upwardly until the upper surface 90a of sleeve 90 engages the lower surface 96a of upper support journal 96. Sleeve 90 moves hub 80 upward with retraction rods 68 to move locking dogs 62 to the retracted position as shown in FIG. 2. Wheels 126 and guide members 142 maintain the device centrally positioned to prevent damage to the inner wall 20 of piling 12.

It should be appreciated that when positioned within the piling 12, hub pin 78 is located below hub pin 76 to limit force exerted on shear pin 112. Thus, hydrostatic pressure against bulkhead 32, which is supported by dogs 62, tend to move the dogs inwardly and downwardly. Since the hub 80 can not move to a lower position after engaging journal 98 and since pin 78 is off centered in a lower position, dogs 62 are positively held in an extended position. Thus, a minimal amount of lateral force resists the larger longitudinal forces due to the hydrostatic pressure. This also relieves pressure on shear pin 110 preventing premature shearing of the pin.

After the locking dogs 62 have been retracted to the position illustrated in FIG. 2, the entire pile closure 10 can be lifted vertically through the piling 12 and lifted to the surface of the water for reuse in another operation.

It should be appreciated that other and further embodiments of the invention may be devised without departing from the basic concept herein.

Having described our invention, we claim:

1. In an offshore drilling platform support structure having hollow tubular legs and tubular members slideably disposed through tubular piling guides to secure the platform support structure in place, the tubular members having sealed ends for transporting to the drilling site and a central tube closure, the improvement comprising: a locking ring secured to the inner wall of the tubular member; a support casing; a bulkhead secured to said support casing; seal means on said support casing sealing with the inner wall of the tubular member; connector means moveable between an extended position engaging the locking ring and a retracted position away from said locking ring; retraction means operably secured to said connector means, said retraction means being arranged to move said connector means from the extended position to the retracted position to permit removal of the central tube closure from the tubular member; and means to equalize pressure on each side of the bulkhead to permit selective flooding of said tubular members.

2. The combination called for in claim 1 wherein the connector means comprises a plurality of spaced locking dogs pivotally secured to said support casing and engageable with annular locking dog receiving groove formed in said locking ring.

3. The combination called for in claim 1 wherein the retraction means comprises: a mandrel slideably disposed to said casing; a hub secured to said mandrel; a plurality of retractor rods secured between said hub and said connector means.

4. The combination called for in claim 3 wherein said retractor rods are individually adjustable to adjust the distance between connector means and the hub.

5. The combination called for in claim 1 wherein said seal means comprises: an inflatable bladder; and means detachably secured to said inflatable bladder to allow deflation of the bladder prior to retraction of the connector means.

6. A closure for use in a tubular member to divide the tubular member into separate compartments, the improvement comprising: a locking ring having an annular groove formed therein secured to the inner wall of said tubular member; a support casing; a bulkhead secured across said support casing, said bulkhead having a passage formed therein; seal means to form a seal between the bulkhead and the inner wall of said tubular member; connector means moveable between an extended position extending into said groove in said locking ring and a retracted position spaced from said locking ring; retraction means operably secured to said connector means, said retraction means being arranged to move said connector means from said extended position to said retracted position to permit removal of said closure from said tubular member; and a flood control valve controlling flow of fluid through said passage in the bulkhead.

7. In an offshore drilling platform support structure having hollow tubular legs and tubular members slideably disposed through tubular piling guides to secure the platform support structure in place, the tubular members having sealed ends for transporting to the drilling site and a central tube closure, the improvement comprising: a locking ring secured to the inner wall of the tubular member; a support casing; a bulkhead secured to said support casing; seal means on said support casing sealing with the inner wall of the tubular member; connector means moveable between an extended position engaging the locking ring and a retracted position away from said locking ring; a mandrel slideably disposed to said casing; a hub secured to said mandrel; a plurality of retractor rods secured between said hub and said connector means, said retractor rods being arranged to move said connector means from the extended position to the retracted position to permit removal of the central tube closure from the tubular member and wherein the ends of the retracting rods secured to said hub are lower than the ends of the retractor rods secured to said connector means when the connector means is extended such that inward force on the connector means is resisted.

8. In an offshore drilling platform support structure having hollow tubular legs and tubular members slideably disposed through tubular piling guides to secure the platform support structure in place, the tubular members having sealed ends for transporting to the drilling site and a central tube closure, the improvement comprising: a locking ring secured to the inner wall of the tubular member; a supporting casing; a bulkhead secured to said support casing; seal means on said support casing sealing with the inner wall of the tubular member; connector means moveable between an extended position engaging the locking ring and a retracted position away from said locking ring; a mandrel; upper and lower support journals secured in said support casing, said mandrel being slideably disposed through said upper and lower support journals, said support journals forming opposed shoulders to form the extremes of upper and lower movement of the mandrel; a hub secured to said mandrel; a plurality of retractor rods secured between said hub and said connector means, said retractor rods being arranged to move said connector means from the extended position to the retracted position to permit removal of the central tube closure from the tubular member.

* * * * *